United States Patent [19]

Lofquist, Jr.

[11] 4,157,104

[45] Jun. 5, 1979

[54] GASOLINE DISPENSING AND VAPOR RECOVERY APPARATUS

[76] Inventor: Alden A. Lofquist, Jr., 10 Rita Way, Orinda, Calif. 94563

[21] Appl. No.: 846,444

[22] Filed: Oct. 28, 1977

[51] Int. Cl.[2] ..... B65B 3/18

[52] U.S. Cl. ..... 141/292; 141/302; 141/311 R; 141/392; 220/85 VR; 220/86 R

[58] Field of Search ..... 141/59, 97, 198, 206–229, 141/285, 286, 290, 291, 295, 301, 302, 305, 346–348, 392, 292, 311 R; 220/86 R, 85 VR

[56] References Cited

U.S. PATENT DOCUMENTS

| | | | |
|---|---|---|---|
| 3,255,789 | 6/1966 | McDonald | 141/392 X |
| 3,880,317 | 4/1975 | Arnett | 141/392 X |
| 3,982,571 | 9/1976 | Fenton | 141/207 X |
| 3,996,978 | 12/1976 | Rapaelian | 141/392 X |
| 3,996,979 | 12/1976 | Barr et al. | 141/392 X |

*Primary Examiner*—Richard E. Aegerter
*Assistant Examiner*—Frederick R. Schmidt
*Attorney, Agent, or Firm*—Limbach, Limbach & Sutton

[57] ABSTRACT

A gasoline dispensing and vapor recovery nozzle, and adaptors and fittings as may be required to modify certain gasoline tank fill pipes to consistent geometry and dimensions, such fittings including extension to the liquid conveying portion of the dispensing nozzle and extension of the venturi vent tube of the automatic shut-off system of the nozzle, thereby permitting early detection and shut-off of fluid flow upon rising liquid levels in the gasoline tank and fill pipe.

5 Claims, 6 Drawing Figures

GASOLINE DISPENSING AND VAPOR RECOVERY APPARATUS

BACKGROUND OF THE INVENTION

This invention relates generally to improvements in the design and construction of apparatus for safely and efficiently dispensing gasoline and recoverying vapors generated and displaced during the refueling process.

The preponderance of prior art on this subject has presented designs that ignore the diversity of dimensions and configurations of gasoline tank fill pipes; that attempt to form a vapor seal against the exposed rim of the fill pipe as being the most accessable, convenient and consistent feature of the pipe; or present adaptors of such complexity that the costs thereof would essentially eliminate such adaptors from use on economic bases.

Additionally, there is legislation by various regulating agencies specifying certain dimensions of nozzles to be employed in dispensing different types of gasoline and specifying minimum performance characteristics of vapor recovery type apparatus; there are general requirements for nozzle designs and materials to satisfy requirements for safety; and there are the practical considerations of commercial gasoline dispensing operations; all these requirements being compounded by the diversity of designs and locations of fill pipes by domestic and foreign vehicle manufacturers.

SUMMARY OF THE INVENTION

The above and other disadvantages of prior art gasoline dispensing systems are overcome by the applicant's invention which comprises a special nozzle for gasoline dispensing and vapor recovery; a valve handle supporting the nozzle and containing valving for both liquids and vapors; and adaptors and fittings to modify the diversity of fill pipe designs to a consistent geometry and dimensions, as well as to provide extensions to both liquid and venturi vent passageways of the dispensing nozzle, such adaptors and fittings to be an essentially permanent although removable portion of the gasoline tank fill pipe.

In accordance with this invention, two principal components of a gasoline dispensing and vapor recovery system are employed to provide a liquid and vapor tight seal between the dispensing and receiving bodies. The first component being the dispensing nozzle, which includes a special design actual nozzle tip, connected to a valve body and a nozzle handle which incorporates separate valve means for both the liquid and vapors as well as a valve tripping means to shut the valves as will be explained in greater detail further herein, with the nozzle handle in turn being connected to the gasoline dispensing pump source and vapor receiver by means of flexible hoses. The second component of the system is the adaptor, which may be of several different forms, fitted to the vehicle fuel tank fill pipe and which includes extended fluid conveying elements from the adaptor toward the fuel tank for some distance depending upon the configuration of the fuel tank and fill pipe. The adaptor provides a consistent geometry and dimensions to permit forming the fluid tight seal with the nozzle tip.

In the preferred form of the invention as shown in the drawings, the nozzle handle is of conventional outward configuration having ports for connection to two hoses, but the nozzle tip is designed with two concentric passageways formed by different diameter tubes; the inner tube conveying the liquid while the outer tube conveys the vapor. The outer tube contains a deformable ring to seal against the bore wall of the adaptor or fill pipe. The adaptor may be of a number of different configurations based upon the design of the fill pipe, several being shown in the drawings to suggest variations that could be employed to satisfy the different operating requirements.

Other forms of this invention are possible to suit specific but differing requirements, but in all cases the principles of the invention would be consistently followed in designing the elements of the valve handle including valving for both the liquid and vapors, the nozzle tip including concentric passageways for both liquids and vapors, an adaptor to fit the vehicle fill pipe and provide consistent dimensions and geometry for the nozzle tip, and extension tubes for conveying fluids from and to the adaptor.

It is therefore a principal object of this invention to provide a liquid dispensing and vapor recovery system that will positively contain all fluids being pumped and displaced during the refueling process.

Another objective of this invention is to provide fuel dispensing and vapor recovery apparatus that is simple, both in design and operation, and economical so that the elements of the apparatus may be reasonably employed by the majority of gasoline stations and owners of vehicles requiring refueling.

A further object of this invention is to provide refueling apparatus that is both safe and relatively free from maintenance or damage that would reduce its intended functions and effectiveness, even when used by persons not trained or normally associated with vehicle refueling equipment and operations.

Still another object of this invention is to provide refueling apparatus that will reduce the generation of vapors during the refueling process, and will reduce the possibility of overfilling of the gasoline tank with the resultant spills which subsequently evaporate.

Still another objective of this invention is to provide receptacles of specific diameters so as to receive on a go/no-go basis the nozzle tips of different diameters according to the fluid being dispensed in accordance with the legal requirements.

Still a further objective of this invention is to provide a nozzle and adaptors that would normally be used one in conjunction with the other to obtain fluid tight sealing, but which may also be effectively utilized in the refueling process separately, that is, the vapor recovery nozzle may be used to refuel vehicles not fitted with adaptors, and vehicles fitted with adaptors may be refueled by conventional gasoline dispensing nozzles other than the nozzle of this invention.

Still a further feature of this invention is that the adaptors of this invention, having consistent geometry and dimensions, will permit the use of gas caps of essentially consistent size and design, and the adaptors themselves will effectively function as a deterrant to fuel pilferage.

Other objects and advantages of the invention will become apparent upon full consideration of the following description and attached drawings.

DETAILED DESCRIPTION OF CERTAIN PREFERRED EMBODIMENTS

Figures 1, 2:
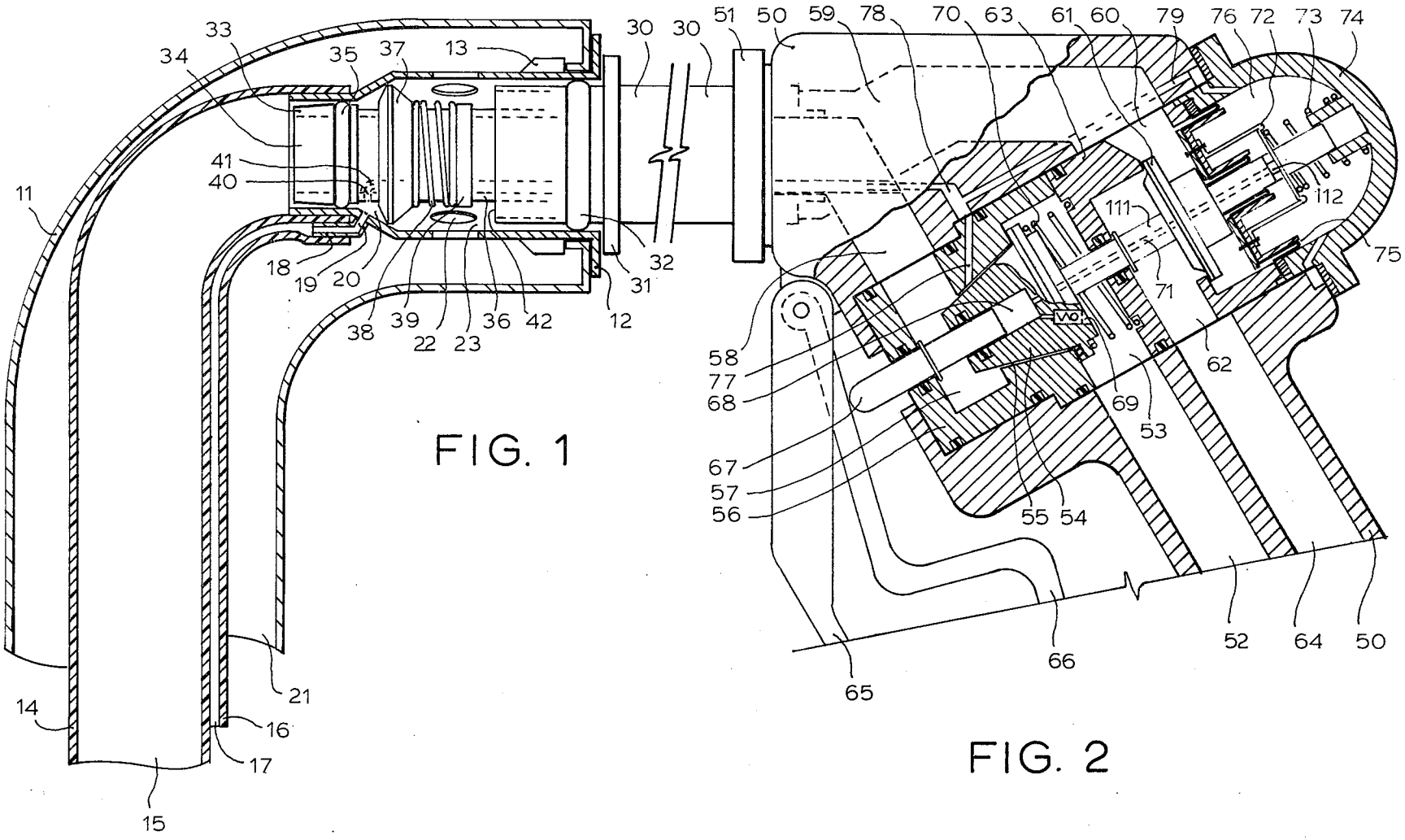
FIG. 1 is a vertical, sectional view through one preferred embodiment of the nozzle tip and adaptor with fuel extension tubes as shown typically in a gasoline fill pipe of a vehicle.
FIG. 2 is a vertical, partial sectional view of a valve handle and the valving means for both liquid and vapor streams, including means for tripping and closing the valves when either the liquid level in the fill pipe reaches a predetermined level or pressure in the system reaches a predetermined point.

Referring now in detail to the drawings, and particularly to one perferred embodiment in FIG. 1, a flanged fuel fill pipe 11 of a vehicle is fitted with an adaptor of this invention. The adaptor 12, with a liquid extension tube 14 and a venturi sensing extension tube 16 previously attached, is inserted into the throat of the fill pipe 11 and rotated so that the lugs 13 engae the outer flange of the fill pipe 11 and lock the adaptor 12 in place. There is static sealing means between the fill pipe 11 and the adaptor 12. The liquid extension tube 14 extends, preferably to the bottom of the gasoline tank proper (not shown) so that all liquid pumped into the vehicle will be discharged below the level of gasoline in the tank thereby reducing turbulance and the generation of volatile vapors. Further, the submerged discharge of liquid will avoid the occasional belching of a liquid and vapor mixture encountered with a conventional refueling nozzle and procedures caused by the entrapment of vapor in the fill pipe and tank by the downward flowing liquid introduced at the throat of the fill pipe.

The venturi sensing extension tube 16 does not extend into the gasoline tank proper, but only a relatively short distance in the range of perhaps 12 inches to 30 inches from the adaptor depending upon the specific dimensions and configuration of the vehicle in which the adaptor assembly is installed. The function of the venturi sensing extension tube 16, working in conjunction with the venturi valve tripping mechanism of the nozzle and valving as will be discussed later, is to provide early detection and shut-off of the flow of liquid from the nozzle when the level of the liquid in the vehicle fill pipe 11 reaches the bore 17 of the venturi sensing extension tube 16, thereby avoiding overfilling of the gasoline tank and fill pipe with resultant spill of liquid outside the fill pipe or into the vapor vent tube from the fill pipe to the vehicle engine or emission control system of the vehicle.

During the process of refueling, the nozzle assembly is inserted into the adaptor 12 forming several fluid tight connections. The first fluid seal is between the nozzle tip and the adaptor 12. The deformable sealing ring 35 which is fitted to the nozzle nosepiece 33, seats against the adaptor 12 so that all liquid dispensed will flow through the liquid fill tube 14. The second seal is between the vapor pipe 30 of the nozzle tip and the adaptor 12. A deformable sealing ring 32 carried by the vapor pipe 30 seats against the adaptor 12 thereby preventing escape of any fluids during the refueling process. A groove cut into the vapor pipe 30 to receive the sealing ring 32, in conjunction with a similar groove (not shown) in the liquid pipe 36, also acts as a breakaway safety feature for the nozzle tip. The third seal is between a seal ring 37 slidably mounted on the liquid pipe 36 and the adaptor 12. The seal ring 37 is normally held in a forward position against the nozzle nosepiece 33 by means of a spring 38 and a fixed ring 39 attached to the liquid pipe 36.

With the nozzle tip assembly inserted into the adaptor 12, the seal ring 37 contacts a necked portion of the adaptor 12 and is pushed back away from the nozzle nosepiece 33, thereby uncovering the venturi vent passageway 40 and forming a chamber 20.

When liquid is dispensed through the nozzle tip, the liquid flows through the liquid pipe 36 and the nozzle nosepiece 33 discharging into passageway 15 of the liquid tube 14 which extends toward and preferably into the receiving tank (not shown). Vapor displaced from the receiving tank by the liquid is forced upward through passageway 21 of fill pipe 11, through the plurality of vapor ports 22 in the adaptor 12 and through the passageway 42 inside the vapor tube 30 and outside the liquid tube 36, through a valving means and handle 50 in FIG. 2, and ultimately to conventional vapor recovery apparatus (which is not shown).

As the fluid rises in the fluid receiving tank and fill pipe 11, the liquid will ultimately cover the lower end of passageway 17 in the venturi vent extension tube 16. Normally, vapor would pass from the fill pipe through passageway 17, passageway 19 in venturi nipple 18, into chamber 20 and through passageway 40 of venturi tube 41 to the venturi tripping system of the valve means, such flow of vapor caused by reduced pressure at the venturi of the valve. When liquid in the fill pipe 11 covers the lower end of passageway 17, the flow of vapor is essentially stopped, tripping the liquid valve and shutting off the liquid flow in a manner which will be described in greater detail further in this specification.

When the nozzle tip assembly is not fully inserted into the adaptor 12, the seal ring 37 covers the opening to the venturi passageway 40 of the nozzle, thereby acting on the venturi tripping system to stop liquid flow through the nozzle. This not only ensures that no vapor is allowed to escape the vapor recovery system, but it also ensures that the nozzle is being inserted into an appropriate adaptor for the liquid which is to be dispensed. By appropriately sizing or keying the adaptors and seal rings 37 to be matched, the apparatus of the invention can be used to prevent the introduction of the wrong kind of liquid into the fill pipe 11, e.g. leaded gasoline into a fill pipe of a car requiring unleaded gasoline.

FIG. 2 shows one preferred form of valving means and a valve handle for controlling the flows of both liquids and vapors, as well as a new form of venturi tripping system for the valves.

In operation, liquid pumped from a bulk storage tank (not shown) flows through passageways 52 and 53, passed a cone shaped liquid valve plug 54 and then through passageways 57 and 58 in the nozzle handle into the liquid pipe 36 (FIG. 1) of the nozzle tip. Vapor from the liquid receiving tank passes through the nozzle tip in the manner previously described, and then through passageways 59 and 60, in the nozzle handle, passed valve 61 and then through passageways 62 and 64 to the conventional vapor receiving vessel (not shown).

The liquid valve 54 and vapor valve 61 are mounted on a common stem 111 with passageway 71 therethrough. The valves with common stem 111 are lifted hydraulically when the valve operating lever 66, protected by guard 65, is hand-operated in a conventional manner to bear against a valve plunger 67. The valve plunger 67 fits in a bore within the valve plug 54 and together they form a chamber 68 which is filled with fluid through a check valve 69 which communicates with the liquid carrying passageway 53. The chamber 68 communicates with one end of passageway 71 which is sealed at its opposite end by a diaphragm support framework 72 containing a valve plug 112 over the passageway 71. The framework 72 and the valve plug 112 are held against the stem and passageway 71 by a coil spring 73. When the valve plunger 67 is lifted by squeezing the hand lever 66, the liquid valve plug 54 and vapor valve 61 are lifted by the pressure of the liquid within the chamber 68 and passageway 71, permitting both liquids and vapors to flow as previously described through the passageways 53 and 62, respectively.

The velocity of the liquid flowing in the space 55 between the valve plug 54 and the valve body 56 creates a static pressure, according to Bernoulli's theorem, which is less than atmospheric or less than the vapor pressure in the liquid fill pipe 11 in FIG. 1, resulting in the connecting venturi passageways 77, 78 and 79 being at a reduced pressure, such reduced pressure being relieved to some extent by the flow of vapor from the fill pipe 11 in FIG. 1, through passageway 78. When the flow of vapor through passageway 78 is interrupted by blockage of the opening in tube 16 in the manner previously described, a further drop in static pressure is experienced in passageways 77, 78 and 79, and in the chamber 76 is formed within the nozzle handle by a diaphragm seal 75, diaphragm support framework 72 and valve cap 74, with said chamber 76 communicating with passageway 79. This reduced pressure in chamber 76, working over the area of the diaphragm 75 and support framework 72 is sufficient to lift the support framework 72 with valve plug 112 from the end of passageway 71, permitting liquid to flow from chamber 68. With the escape of the liquid from chamber 68, the stem 111 drops due to the force of the coil spring 70 and thereby closes liquid valve plug 54 and vapor valve 61. Similarly, an increase of a predetermined magnitude in the vapor pressure, caused, for example, by liquid entering the vapor recovery passageways, will also raise the diaphragm 75 and cause the stem 111 to drop and close the valves 54 and 61.

Upon release of the valve lever 66, the liquid pressure in passageway 53 will cause liquid to flow through check valve 69 into chamber 68 and thereby return valve plunger 67 to its normal operating position. The return of the valve plunger 67 to its normal operating position can also be assisted by the addition of a spring (not shown). The diaphragm support framework 72 and plug 112 also seat on and seal the passageway 71 upon stopping of the liquid flow thorugh liquid valve 54.

Figure 3:
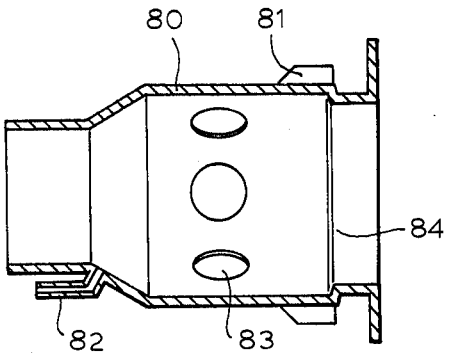
FIG. 3 is a sectional view of another adaptor according to the invention for fill pipes with flanged ends, as generally shown installed as in FIG. 1, but with the adaptor modified by the inclusion of an internal lip so as to accommodate the vapor recovery nozzles of the types currently being used commercially in some locations and as illustrated in FIG. 6.

FIG. 3 shows another form of an adaptor according to the invention, which essentially is equivalent to the adaptor 12 of FIG. 1, but which is modified to include a lip 84 at the nozzle entry to permit the engagement of a seal ring (such as shown as 102 in FIG. 6) currently employed by several commercial designs of vapor recovery nozzles. In other regards, the features of the adaptor 80 are similar to adaptor 12 of FIG. 1, with the locking lugs 81, venturi nipple 82 and vapor ports 83 being shown.

Figure 4:
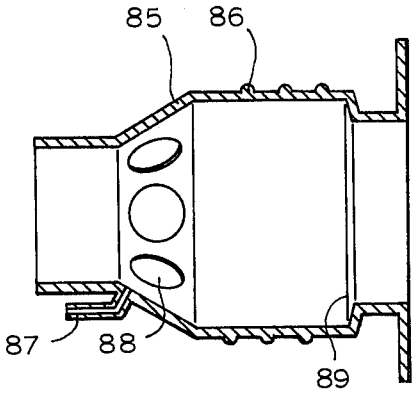
FIG. 4 is a sectional view of still another adaptor according to the invention that would be employed in vehicle fill pipes having threaded rather than flanged means for accepting and securing the gas cap.

FIG. 4 is another form of an adaptor according to the invention which is designed to be employed in fill pipes having a screwed rather than flanged fill pipe cap connection. The features of the adaptor 85 are similar to the adaptor 80 of FIG. 3, with the venturi nipple 87, vapor ports 88 and lip 89, and with threads 86 used instead of the lugs 81 of FIG. 3.

Figure 5:
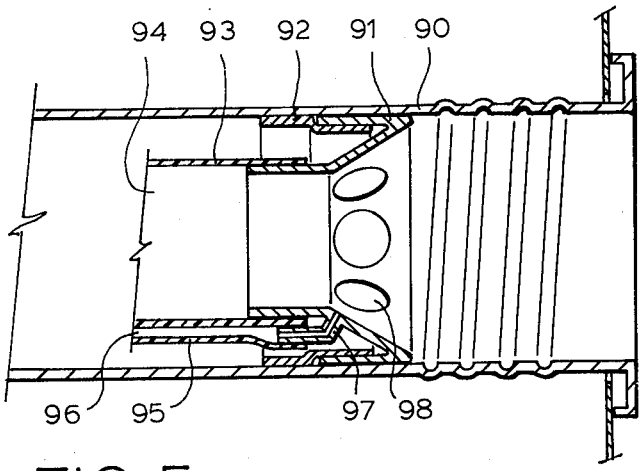
FIG. 5 is a sectional view of yet another adaptor according to the invention, shown installed in a fill pipe, and one means of securing the adaptor, in fill pipes of vehicles in which the adaptor or securing means is built into the fill pipe at the time and point of manufacture.

FIG. 5 shows still another adaptor 91 according to the invention which is to be essentially permanently installed in the fill pipe 90, at the time of manufacture of the fill pipe 90. Permanent fastening means such as retainer ring 92 can therefore be installed. Other features of the adaptor 91 are similar to the adaptor described previously, including a liquid tube 93 forming a liquid passageway 94, a venturi vent tube 95 and passageway 96 which connects to a venturi nipple 97 and vapor ports 98. The vapor seal of the nozzle tip is made against the interior wall of the fill pipe 90 in this instance instead of against the interior wall of adaptors as previously noted.

Figure 6:
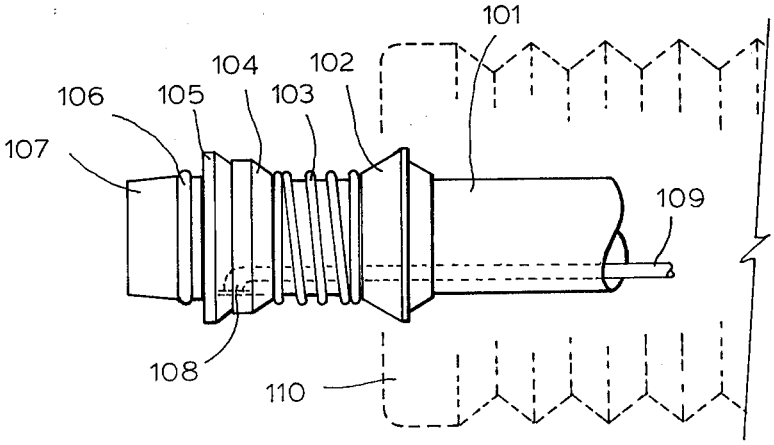
FIG. 6 is a partial view of the tip of a nozzle with a bellows sealing means as currently employed on vapor recovery type nozzles, with the tip being modified to fit and function with the adaptors as shown.

FIG. 6 shows a variation of a type of vapor recovery nozzle now being used commercially, in which the elastomeric bellows boot 110 for collecting vapors is restrained in the full forward position, when the nozzle is not in use, by an engaging ring 102. The engaging ring 102, as shown, is a variation of the designs as currently employed, such variation being made to permit the matching of this type of nozzle to the adaptors of this invention. Functionally, the engaging ring 102 also performs as the fixed ring 39 of FIG. 1, and all other parts of the tip of this nozzle function in the same manner and for the same purposes as previously described for FIG. 1.

While the apparatus of the invention has been described above with particular reference to gasoline and other fuel dispensing systems it should be recognized that the apparatus has other applications such as dispensing toxic liquids. It is extremely important in dispensing some liquid pesticides, for example, that no vapors or liquid be allowed to escape the dispensing nozzle or the container to be filled. The dispensing apparatus of the invention as described above is well suited to this task.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed.

What is claimed is:

1. Apparatus for dispensing volatile liquids into a container having a filling port and for simultaneously recovering vapor thereby generated, the apparatus comprising:

a nozzle having separate liquid dispensing and vapor recovery passageways, a handle for supporting the nozzle and for connecting it to external liquid pumping and vapor recovery means, the handle further including separate liquid and vapor, hand-operated shut-off valves for the nozzle liquid dispensing and vapor recovery passageways, and pneumatically operated valve actuator means for simultaneously shutting off both valves, the valve actuator means including a venturi passageway extending through the nozzle which passageway is normally open at one end, the valve actuator means being triggered by blockage of the open end of the venturi passageway, a hollow adaptor for receiving the nozzle and including means for attaching the adaptor in the filling port of the container, the adaptor having separate liquid dispensing, vapor recovery and venturi passageways and connector means for forming removable, fluid tight, separate interconnections between these passageways of the adaptor and those of the nozzle upon insertion of the nozzle into the adaptor.

2. Dispensing apparatus as recited in claim 1, wherein the nozzle includes a spout and the venturi passageway's open end opens to the exterior surface of the spout, and further including a spring sealing ring slideably mounted on the spout and movable on the spout between a first position which blocks the venturi passageway's open end and a second position which uncovers it, a spring to bias the sealing ring to the first position, and wherein the adaptor is internally configured to engage with the sealing ring and force it against the spring to the second position when the nozzle spout is fully inserted in the adaptor.

3. Dispensing apparatus as recited in claim 2, wherein the internal configuration of the adaptor and the external configuration of the sealing ring are matched in a male and female relationship to ensure that the container having the adaptor is only filled from an appropriate nozzle.

4. Dispensing apparatus as recited in claim 1, further comprising a hollow adaptor extension tube for attachment to the adaptor within the container, the extension tube having a fluid passageway therein which is connected to the fluid passageway of the adaptor to convey fluids to and from the adaptor situated in the container filling port.

5. Dispensing apparatus as recited in claim 1, further comprising a hollow adaptor extension tube for attachment to the adaptor within the container to connect to and extend the venturi passageway of the adaptor into the container.

* * * * *